US007291978B2

(12) United States Patent
Rhee

(10) Patent No.: US 7,291,978 B2
(45) Date of Patent: Nov. 6, 2007

(54) PLASMA DISPLAY PANEL AND METHOD FOR MANUFACTURING THE SAME

(75) Inventor: Byung Joon Rhee, Seoul (KR)

(73) Assignee: LG Electronics Inc., Seoul (KR)

( * ) Notice: Subject to any disclaimer, the term of this patent is extended or adjusted under 35 U.S.C. 154(b) by 146 days.

(21) Appl. No.: 10/890,405

(22) Filed: Jul. 14, 2004

(65) Prior Publication Data

US 2005/0029940 A1 Feb. 10, 2005

(30) Foreign Application Priority Data

Jul. 16, 2003 (KR) ..... 10-2003-0048732

(51) Int. Cl.
*H01J 17/49* (2006.01)

(52) U.S. Cl. ..... 313/586; 313/587

(58) Field of Classification Search ..... 313/581–587; 445/23, 24, 38, 53; 427/58; 315/169.4; 345/37, 41, 60

See application file for complete search history.

(56) References Cited

U.S. PATENT DOCUMENTS 5,883,462 A * 3/1999 Ushifusa et al. ..... 313/292
5,905,336 A * 5/1999 Van Hal et al. ..... 313/497
6,888,310 B2 * 5/2005 Tadaki et al. ..... 313/586
6,940,227 B2 * 9/2005 Aoki et al. ..... 313/586
2003/0168979 A1 * 9/2003 Ahn et al. ..... 313/587
2003/0218424 A1 * 11/2003 Law et al. ..... 313/587
2004/0095296 A1 * 5/2004 Kojima et al. ..... 345/60

FOREIGN PATENT DOCUMENTS

JP 02288047 A * 11/1990
JP 06020605 A * 1/1994

* cited by examiner

*Primary Examiner*—Ashok Patel
(74) *Attorney, Agent, or Firm*—Ked & Associates, LLP

(57) ABSTRACT

The present invention discloses a plasma display panel and method for manufacturing the same wherein the quality of an image can be improved by preventing an erroneous discharge. A plasma display panel having a number of discharge cells according to an embodiment of the present invention includes barrier ribs by which a discharge space is defined between an upper substrate and a lower substrate; and an oxide film of a low dielectric constant formed on each of the barrier ribs. A method for manufacturing a plasma display panel according to an embodiment of the present invention includes the steps of: forming barrier ribs on a lower substrate so that a discharge space is defined by the barrier ribs between an upper substrate and a lower substrate; and forming an oxide film of a low dielectric constant on each of the barrier ribs. According to a PDP and method for manufacturing the same of the present invention, since an erroneous discharge does not occur, the quality of an image of a plasma display panel is improved.

20 Claims, 11 Drawing Sheets

PLASMA DISPLAY PANEL AND METHOD FOR MANUFACTURING THE SAME

This Nonprovisional application claims priority under 35 U.S.C. § 119(a) on Patent Application No. 10-2003-0048732 filed in Korea on Jul. 16, 2003, the entire contents of which are hereby incorporated by reference.

BACKGROUND OF THE INVENTION

1. Field of the Invention

The present invention relates to a plasma display panel and method for manufacturing the same, and more particularly, to a plasma display panel and method for manufacturing the same wherein the quality of an image can be improved by preventing an erroneous discharge.

2. Description of the Background Art

Various flat panel display devices have recently been developed which can reduce their heavy weight and large volume as shortcomings of the cathode ray tube. These flat panel display devices include a liquid crystal display (LCD), a field emission display (FED), a plasma display panel (hereinafter, referred to as "PDP"), an electro-luminescence (EL) display device and so on.

Among them, the PDP is a display device using a gas discharge and has a competitive advantage in that it can be easily fabricated as a large-sized panel. An example of a representative PDP includes a three-electrode AC surface discharge type PDP having three electrodes and driven by an AC voltage, as shown in FIG. 3.

A discharge cell of the PDP shown in FIG. 1 includes an address electrode 12X formed on a lower substrate 18, and a pair of sustain electrodes formed on the underside of an upper substrate 10, i.e., a scan/sustain electrode 12Y and a common sustain electrode 12Z. In FIG. 1, the lower substrate 18 is shown with it rotated by 180°.

A lower dielectric layer 22 for accumulation of wall charges is formed on the lower substrate 18 having the address electrode 12X formed thereon. Barrier ribs 24 are formed on the lower dielectric layer 22. A phosphor layer 20 is covered on the surface of the lower dielectric layer 22 and the barrier rib 24. The barrier ribs 24 serve to prevent ultraviolet rays and a visible ray generated by a discharge from leaking toward a neighboring discharge cell. The phosphor layer 20 is excited by ultraviolet rays generated upon the discharge of gas to generate any one of red, green and blue visible rays. An insert gas is injected into a discharge space provided between the upper/lower substrates 10 and 18 and the barrier rib 24.

The pair of the sustain electrodes 12Y and 12Z formed on the underside of the upper substrate 10 consists of a transparent electrode 12*a* and a bus electrode 12*b* and intersect an address electrode 12X.

The transparent electrode 12*a* is formed of a transparent conductive material in order to shield light supplied from the discharge cell. The bus electrode 12*b* compensates for the conductivity of the transparent electrode 12*a* having a low conductivity due to relatively high resistance property.

An upper dielectric layer 14 and a protection film 16 are formed on the upper substrate 10 in which the pair of the sustain electrodes 12Y and 12Z are formed. The upper dielectric layer 14 has a wall charge accumulated thereon upon discharge. The protection film 16 serves to prevent damage of the upper dielectric layer 14 due to sputtering generated upon plasma discharge and also to increase discharge efficiency of secondary electrons. The protection film 16 is usually formed of magnesium oxide (MgO).

Such a discharge cell having the above structure is selected by an opposite discharge between the address electrode 12X and the scan/sustain electrode 12Y, and maintains a discharge by means of the surface discharge between the pair of the sustain electrodes 12Y and 12Z.

In this discharge cell, the phosphor layer 20 is light-emitted by means of ultraviolet rays generated upon sustain discharge, so that a visible ray is emitted to the outside of the cell. As a result, the discharge cell controls the period where the discharge is maintained to implement gray scale (also called "gradation") and the PDP whose discharge cells are arranged in the form of a matrix displays an image.

FIGS. 4 to 7 illustrate a method for manufacturing a lower substrate of a conventional plasma display panel.

An address electrode 12X is formed on a lower substrate 18 by means of a photo method, a printing method, etc., as shown in FIG. 4. A paste in which a mixed powder having an oxide of a fine powder state mixed with PbO or non-PbO glass fine powder based on a composition ratio is mixed with an organic solvent is covered on the lower substrate 18 in which the address electrode 12X is formed by means of a screen-printing method. Thereafter, the paste covered on the lower substrate 18 is sintered at a given temperature to form a lower dielectric layer 22 on the lower substrate 18 having the address electrode 12X formed thereon, as shown in FIG. 5.

Barrier ribs 24 are formed on the lower dielectric layer 22 by means of a screen printing method, a sand blasting method, a pressing method, etc., as shown in FIG. 6.

Thereafter, a phosphor layer 20 is formed on the substrate on which the barrier ribs 24 and the lower dielectric layer 22 are formed by means of a screen printing method, a printing method and the like, as shown in FIG. 7.

The lower substrate of the PDP formed thus is closely adhered to the upper substrate by means of a sealing process (not shown).

In order to facilitate formation of a wall charge upon reset discharge, the upper dielectric layer of the conventional PDP contains a material of a high dielectric constant such as Pb (lead), Zr (zirconium), $TiO_3$, etc. and the barrier rib also contains a material of a high dielectric constant such as Pb(lead), Zr(zirconium m), $TiO_3$ and so on. Thereby, a number of wall charges are formed on the lateral sides of the barrier ribs 24 as well as the upper dielectric layer 14 upon reset discharge. However, since unwanted wall charges are formed on the barrier ribs of the PDP and the wall charges formed in a scan/sustain electrode 12Y are removed by these wall charges, erroneous discharge frequently occurs.

More specifically, during a reset period, a discharge occurs between the scan/sustain electrode 12Y and a common sustain electrode 12Z and between the scan/sustain electrode 12Y and the address electrode 12X. Therefore, during the reset period, a wall charge of the negative polarity is formed in the scan/sustain electrode 12Y, a wall charge of the positive polarity is formed in the common sustain electrode 12Z, and a wall charge of the positive polarity is formed in the address electrode 12X, respectively.

In the above, the barrier ribs 24 are formed of a material having a high dielectric constant. Thus, a wall charge is formed even in the barrier ribs 24 during the reset period, as shown in FIG. 8. In this case, wall charges 45 formed on the barrier ribs 24 are formed in the opposite polarity to a neighboring electrode. Accordingly, it serves to offset wall charges 55 of the electrode. That is, the amount of the wall charges 55 formed on the electrodes is reduced by means of the wall charges 45 formed on the barrier ribs 24.

Accordingly, since wall charges are sufficiently not formed on the electrodes during the reset period, an instable address discharge occurs. For this reason, an optical waveform A is shaken due to the address discharge, as shown in FIG. 9. Thereby, there occurs a problem in that the quality of an image is degraded since an erroneous discharge occurs in the PDP, which affects the image quality of a panel.

SUMMARY OF THE INVENTION

Accordingly, an object of the present invention is to solve at least the problems and disadvantages of the background art.

An object of the present invention is to provide a PDP and method for manufacturing the same wherein the quality of an image is improved by preventing an erroneous discharge.

To achieve the above objects, according to one aspect of the present invention, there is provided a plasma display panel having a plurality of discharge cells, including barrier ribs by which a discharge space is defined between an upper substrate and a lower substrate; and an oxide film of a low dielectric constant formed on each of the barrier ribs.

According to another aspect of the present invention, there is also provided a method for manufacturing a plasma display panel, including the steps of: forming barrier ribs on a lower substrate so that a discharge space is defined by the barrier ribs between an upper substrate and a lower substrate; and forming an oxide film of a low dielectric constant on each of the barrier ribs.

According to a PDP and method for manufacturing the same of the present invention, since an erroneous discharge does not occur, the quality of an image of a plasma display panel is improved.

BRIEF DESCRIPTION OF THE DRAWINGS

The invention will be described in detail with reference to the following drawings in which like numerals refer to like elements.

DETAILED DESCRIPTION OF PREFERRED EMBODIMENTS

Preferred embodiments of the present invention will be described in a more detailed manner with reference to the drawings.

A plasma display panel may hereafter be described as having a plurality of discharge cells, including barrier ribs by which a discharge space is defined between an upper substrate and a lower substrate, and an oxide film of a low dielectric constant formed on each of the barrier ribs.

The oxide film of the plasma display panel may include at least one of silicon oxide and magnesium oxide.

The plasma display panel may further include a first electrode formed on the underside of the upper substrate and a second electrode formed on the underside of the upper substrate in such a manner as to extend over the first electrode.

A first barrier rib may be arranged in parallel with the first and second electrodes and have an auxiliary discharge space. A second barrier rib may be arranged to intersect the first barrier rib.

A method for manufacturing a plasma display panel may hereafter be described as including forming barrier ribs on a lower substrate so that a discharge space is defined by the barrier ribs between an upper substrate and a lower substrate, and forming an oxide film of a low dielectric constant on each of the barrier ribs.

The oxide film may include at least one of silicon oxide and magnesium oxide.

The method may also include forming a first electrode on the upper substrate, and forming a second electrode on the underside of the upper substrate in such a manner as to extend over the first electrode.

Forming the barrier rib may include forming a first barrier rib arranged in parallel with the first and second electrodes and having an auxiliary discharge space, and forming a second barrier rib that intersects the first barrier rib.

Hereinafter, preferred embodiments of the present invention will be described in a more detailed manner with reference to FIGS. 10 to 20.

Figure 1:
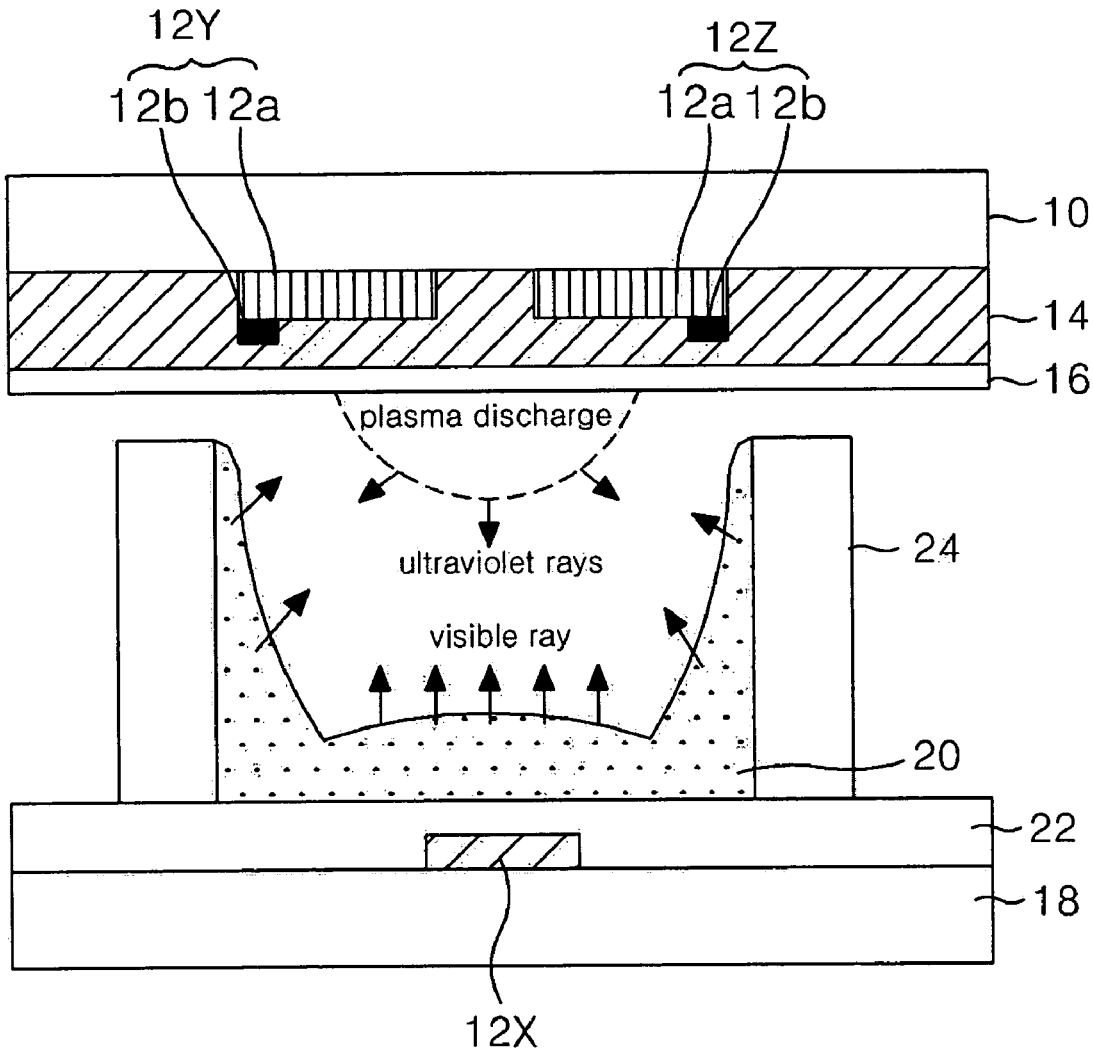
Fig. 1 RELATED ART
FIG. 1 is a cross-sectional view showing the construction of a conventional three-electrode AC type plasma display panel.
Figure 2:
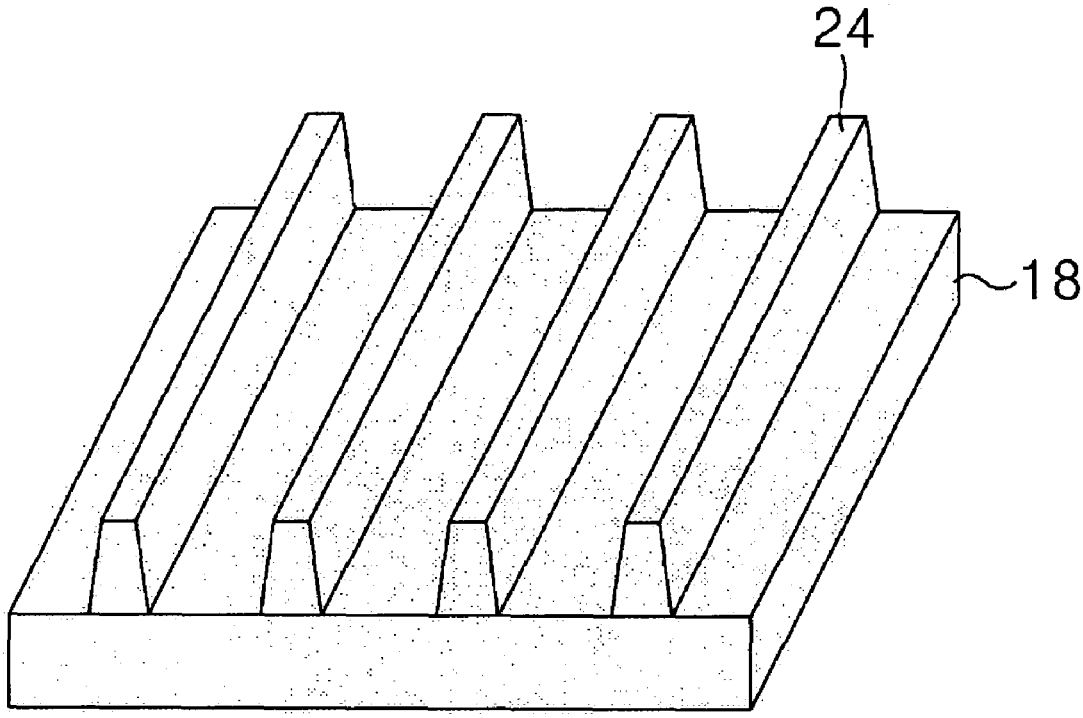
Fig. 2 RELATED ART
FIG. 2 shows a stripe type barrier rib of the conventional plasma display panel.
Figure 3:
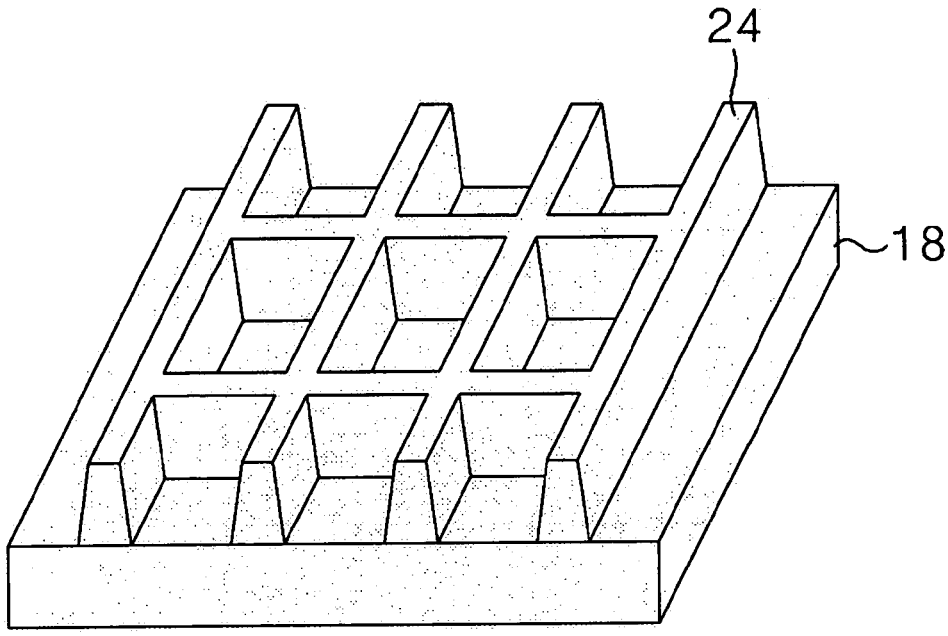
Fig. 3 RELATED ART
FIG. 3 shows a lattice type barrier rib of the conventional plasma display panel.
Figure 4:
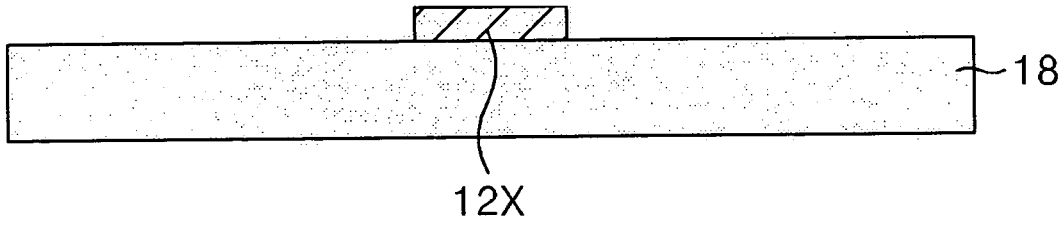
Fig. 4 RELATED ART
FIGS. 4 to 7 illustrate a method for manufacturing a lower substrate of the conventional plasma display panel.
Figure 5:
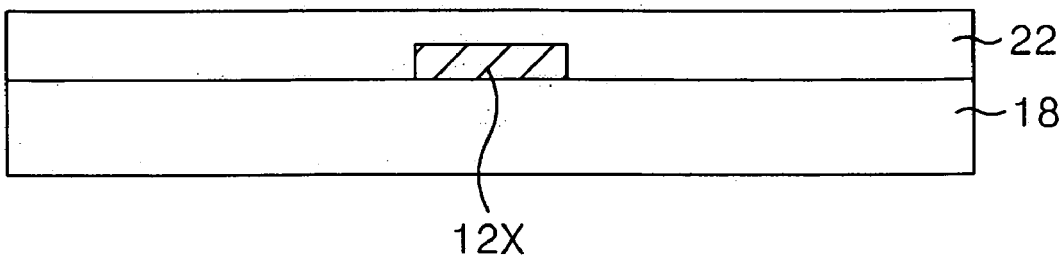
Fig. 5 RELATED ART
Figure 6:
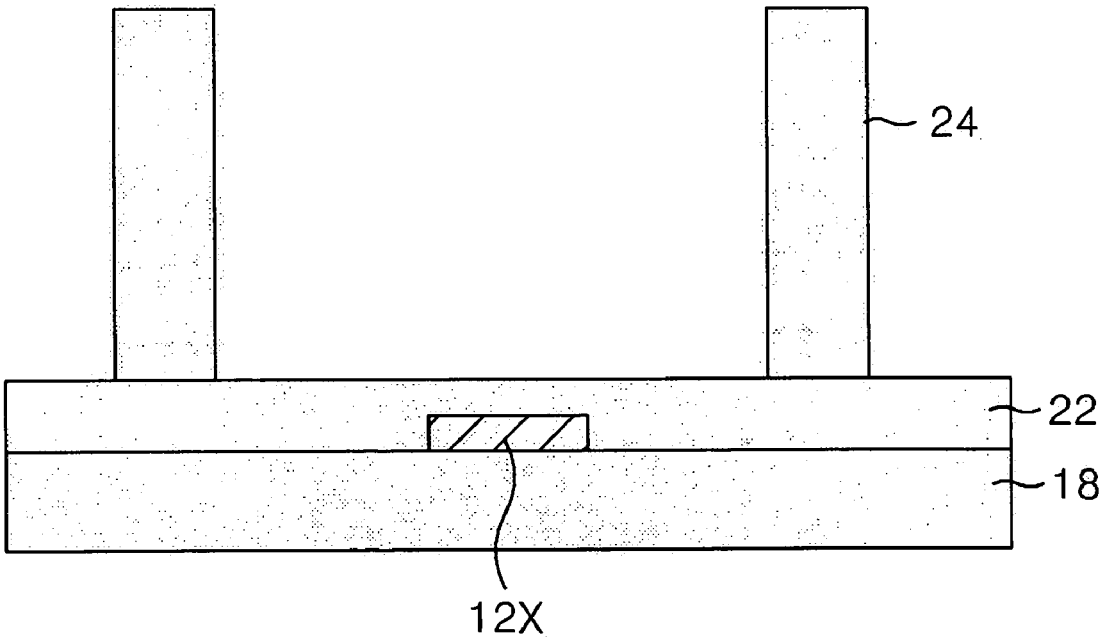
Fig. 6 RELATED ART
Figure 7:
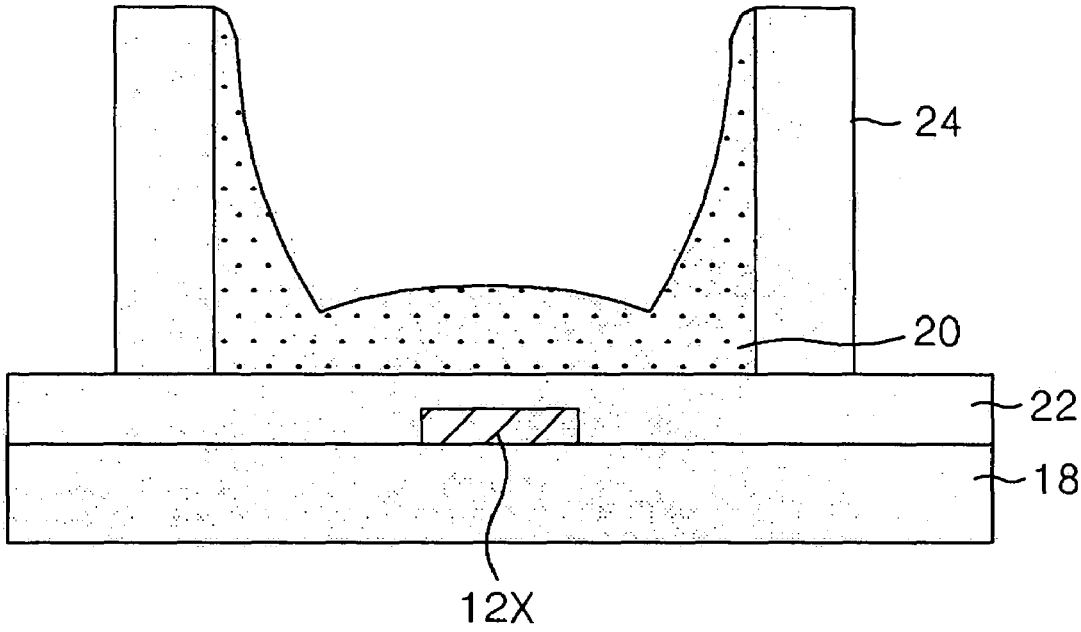
Fig. 7 RELATED ART
Figure 8:
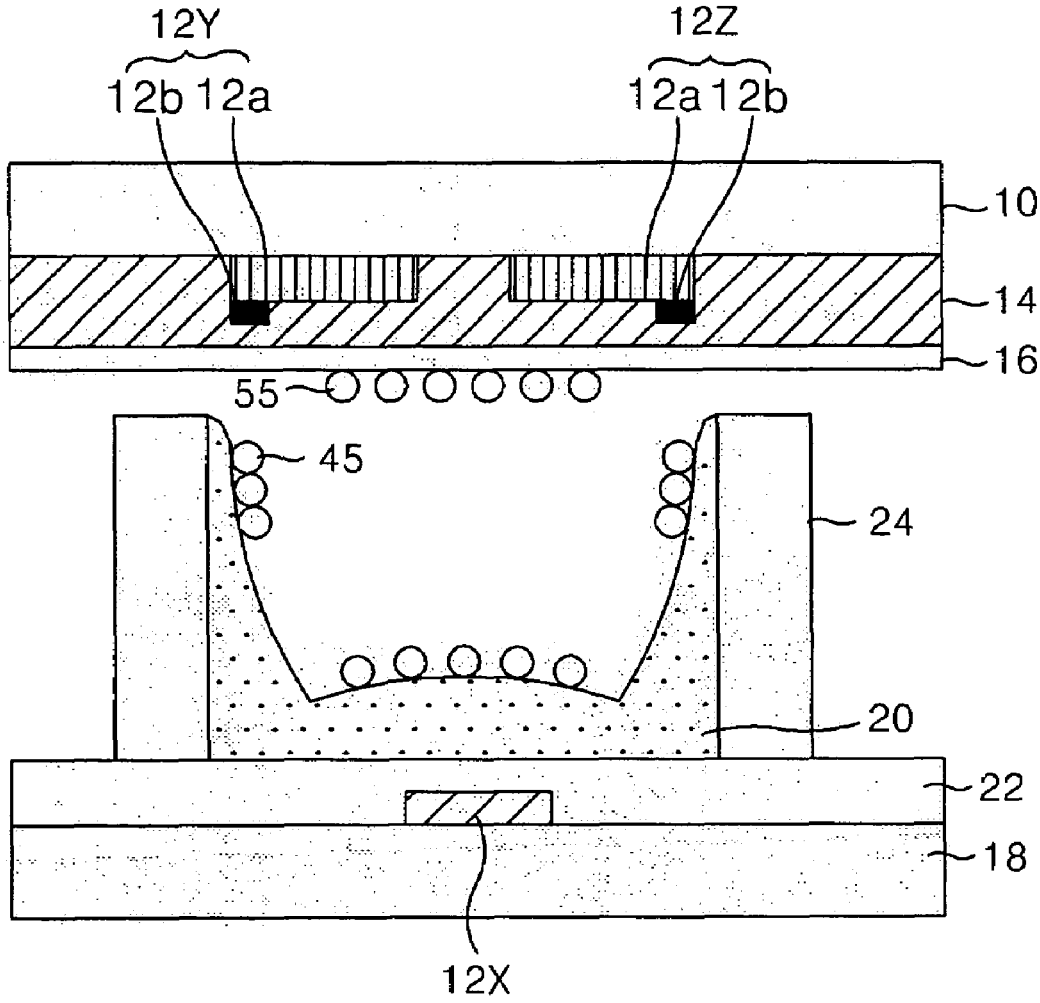
Fig. 8 RELATED ART
FIG. 8 shows the construction of a wall charge formed on the barrier rib of the conventional plasma display panel.
Figure 9:
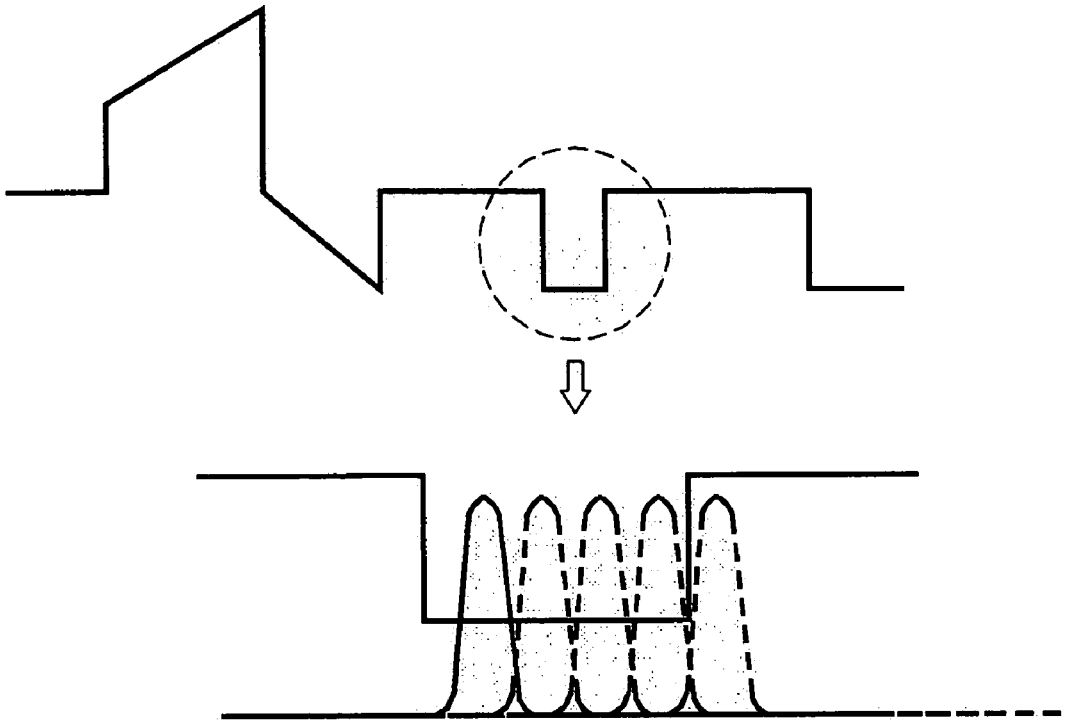
Fig. 9 RELATED ART
FIG. 9 shows shaking of optical waveforms generated by the wall charge formed on the barrier rib shown in FIG. 8.
Figure 10:
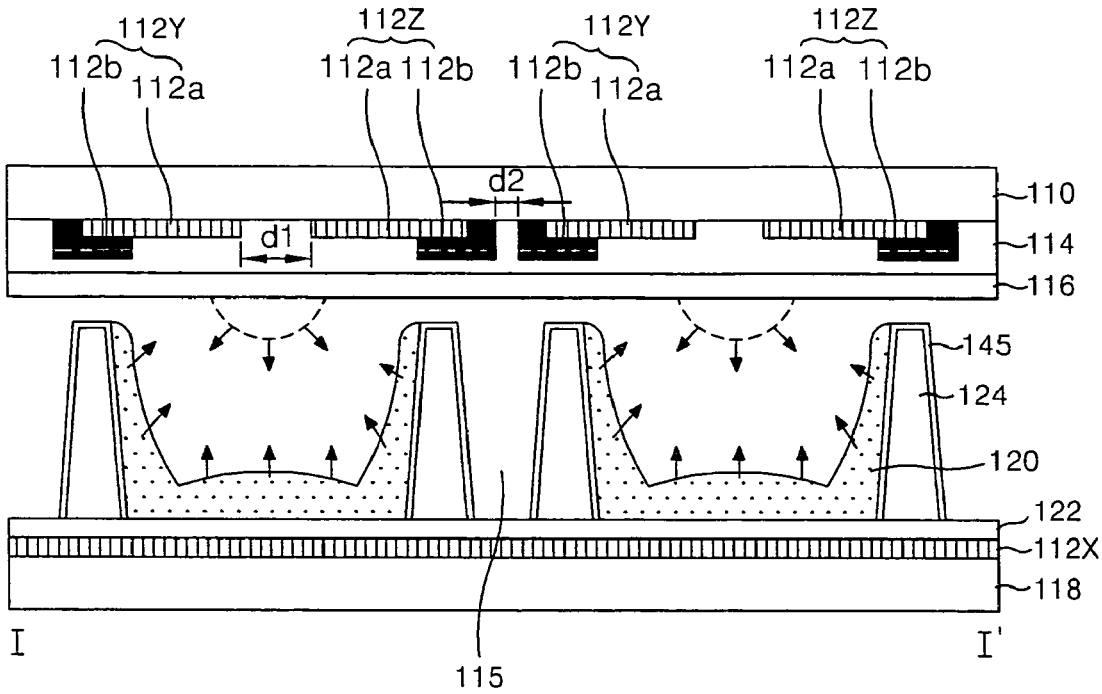
FIG. 10 is a cross-sectional view showing the construction of a discharge cell of a plasma display panel according to an embodiment of the present invention.
Figure 11:
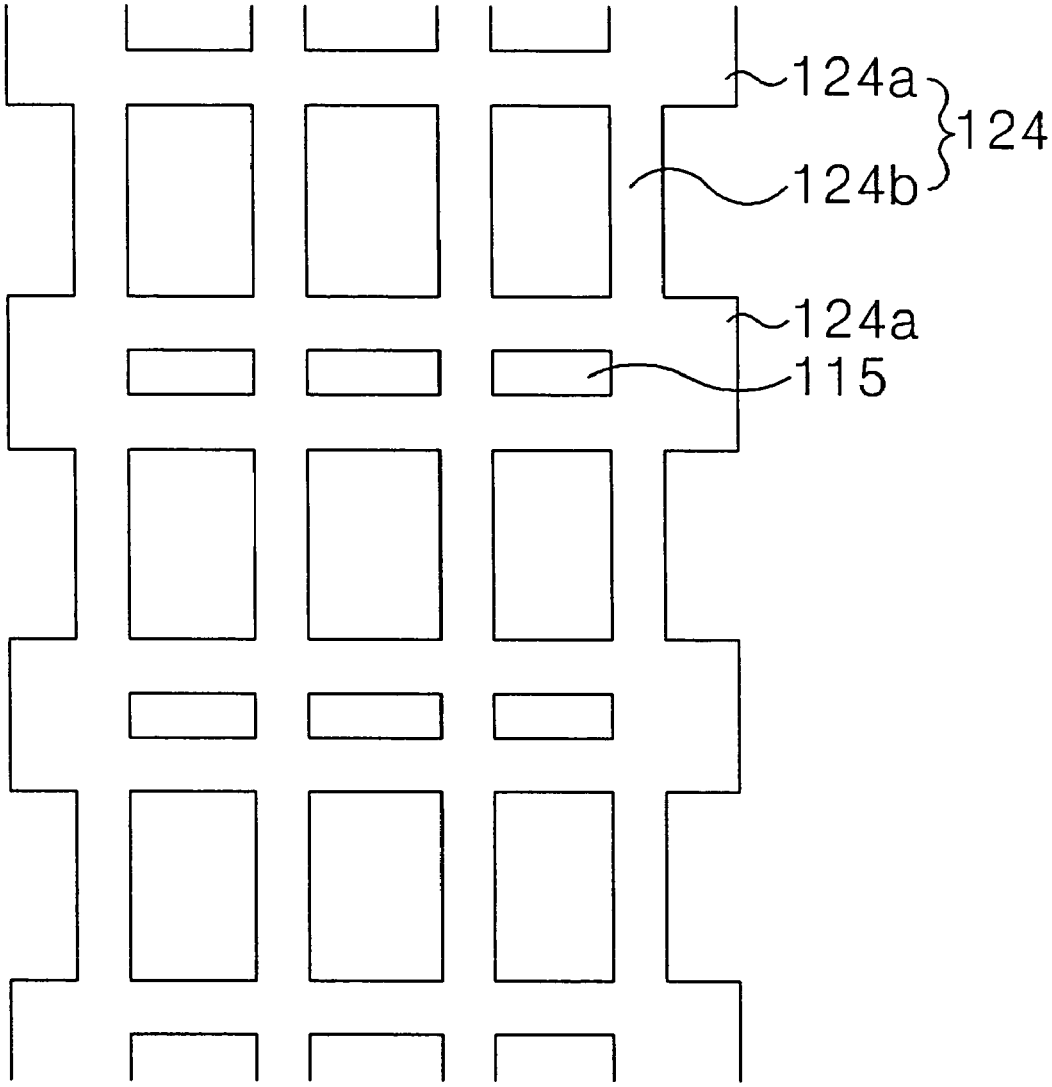
FIG. 11 illustrates a lattice type barrier rib having an auxiliary discharge space shown in FIG. 10.

FIG. 10 is a cross-sectional view showing the construction of a discharge cell of a PDP (plasma display panel) according to an embodiment of the present invention. FIG. 11 illustrates a lattice type barrier rib having an auxiliary discharge space shown in FIG. 10.

Referring to FIG. 10, the discharge cell of the PDP according to an embodiment of the present invention includes an address electrode 112X formed on a lower substrate 118, and a pair of sustain electrodes formed on the underside of an upper substrate 110, i.e., a scan/sustain electrode 112Y and a common sustain electrode 112Z.

A lower dielectric layer 122 for accumulation of wall charges is formed on the surface of the lower substrate 118 on which the address electrode 112X is formed. A lattice type barrier rib 124 overlapped with a bus electrode 112*b* is formed on the lower dielectric layer 122. An oxide film 145 is formed on the lattice type barrier rib 124. A phosphor layer 120 is covered on the surface between of the oxide film 145 and the lower dielectric layer 120.

As shown in FIG. 11, the lattice type barrier rib 124 serves to prevent ultraviolet rays and a visible ray generated by a discharge from leaking toward a neighboring discharge cell. The lattice type barrier rib 124 includes a horizontal barrier rib 124*a* in parallel to the pair of the sustain electrodes 112Y and 112Z, and a vertical barrier rib 124*b* intersecting the pair of the sustain electrodes 112Y and 112Z. In the horizontal barrier rib 124*a* of the lattice type barrier rib 124, discharge cells that are adjacent to each other up and down with an auxiliary discharge space 115 intervened between them are divided. The vertical barrier rib 124*b* divides discharge cells that are adjacent to each other right and left.

Upon address discharge, priming particles are created in the auxiliary discharge spaces 115 due to differences in voltage between the scan/sustain electrode 112Y and the common sustain electrode 112Z in a neighboring discharge cell and are then supplied to a neighboring discharge cell that will be selected next time. A wall charge is sufficiently formed in the discharge cell to which the priming particles are supplied by means of the priming effect, thus helping an address discharge. That is, the amount of wall charges offset by the conventional barrier rib is compensated for by the priming particles. Consequently, an erroneous discharge of the PDP due to conventional unstable address discharge does not occur.

The oxide film 145 is formed of at least one of silicon oxide ($SiO_2$) and magnesium oxide (MgO) having a low dielectric constant. It minimizes the amount of wall charges formed on the lateral side of the barrier rib 124. In the concrete, the barrier rib 124 containing a material of a high dielectric constant is serially connected to the oxide film 145 of a material of a low dielectric constant. In other words, as the barrier rib 124 and the oxide film 145 are serially connected, a total amount of electric charges of the barrier rib 124 and the oxide film 145 is reduced. Thereby, since the amount of the wall charge formed on the barrier rib 124 is significantly reduced compared to a prior art, the wall charge formed in the electrodes is also reduced or minimized. Accordingly, an erroneous discharge of the PDP due to unstable address discharge is not generated.

The phosphor layer 120 is excited by ultraviolet rays generated upon plasma discharge to generate any one of red, green and blue visible rays. An insert gas for gas discharge is injected into a discharge space formed between the upper/lower substrates 110 and 118 and the barrier rib 124.

Each of the pair of the sustain electrodes 112Y and 112Z formed on the underside of the upper substrate 110 consists of a transparent electrode 112*a* and a bus electrode 112*b* and intersects the address electrode 112X.

The transparent electrode 112*a* through which light supplied from the discharge cell passes is formed of a transparent conductive material. The bus electrode 112*b* is formed on the underside of the upper substrate 110 in such a manner as to extend over the transparent electrode 112*a* and compensates for the conductivity of the transparent electrode 112*a* having low conductivity due to relatively high resistance property.

A distance d2 between the bus electrodes 112*b* between the auxiliary discharge spaces 115 formed within the horizontal barrier rib 124*a* is narrower than a distance d1 between the transparent electrodes 112*a* within each discharge cell, i.e., within a main discharge space. By forming the distance d2 between the bus electrodes 112*b* within the auxiliary discharge space 115 narrower than the distance d1 between the transparent electrodes 112*a* within the main discharge space, it is possible to easily form priming particles with even a relatively low voltage.

An upper dielectric layer 114 and a protection film 116 are formed on the upper substrate 110 on which the pair of the sustain electrodes 112Y and 112Z are formed. A wall charge generated upon plasma discharge is accumulated on the upper dielectric layer 114. The protection film 116 serves to prevent damage of the upper dielectric layer 114 due to sputtering generated upon plasma discharge and to increase discharge efficiency of secondary electrons. The protection film 116 is usually formed of magnesium oxide (MgO).

The discharge cell of such a structure is selected by an opposite discharge between the address electrode 112X and the scan/sustain electrode 112Y and then maintains a discharge by means of a surface discharge between the pair of the sustain electrodes 112Y and 112Z. In this discharge cell, the phosphor layer 120 emits light by means of ultraviolet rays generated upon sustain discharge, so that a visible ray is discharged to the outside of the cell. As a result, the discharge cells controls the period where the discharge is maintained to implement gradation and the PDP whose discharge cells are arranged in the formed of a matrix displays an image.

As such, in the PDP according to an embodiment of the present invention, the auxiliary discharge space 115 is formed within the horizontal barrier rib 124*a* of the lattice type barrier rib 124*a*. Thus, priming particles are generated by means of differences in voltage between the scan/sustain electrode 112Y and the common sustain electrode 112Z. The priming particles are supplied to a neighboring discharge cell that will be selected next time and the amount of wall charges offset by the conventional barrier rib are compensated for the priming particles.

Furthermore, in the PDP according to an embodiment of the present invention, the oxide film 145 of a low dielectric constant is formed on the barrier rib 124 of a high dielectric constant. Thus, the amount of a wall charge formed on the lateral side of the barrier rib 124 is minimized.

As such, by minimizing the amount of the wall charge formed on the barrier rib 124 and compensating for the amount of the wall charge whose priming particles generated from the auxiliary discharge space 115 are reduced, the PDP does not generate an erroneous discharge due to unstable address discharge. Accordingly, since the erroneous discharge is prevented, the quality of the image in the PDP can be improved.

FIGS. 12 to 15 show a method for manufacturing the upper substrate of the plasma display panel shown in FIG. 10.

Figure 12:
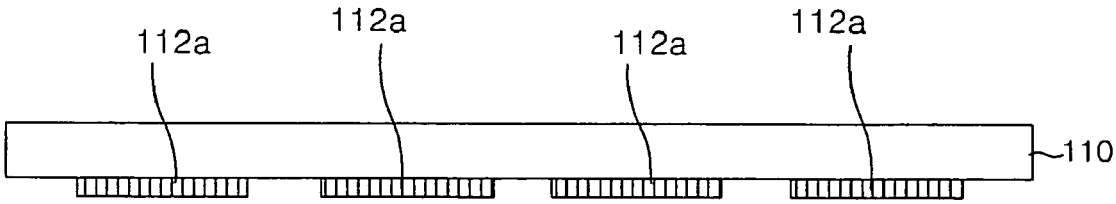
FIGS. 12 to 15 show a method for manufacturing an upper substrate of the plasma display panel shown in FIG. 10.
Figure 13:
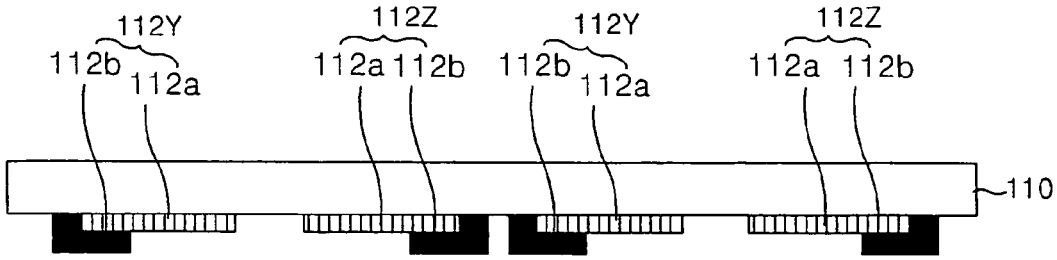
Figure 14:
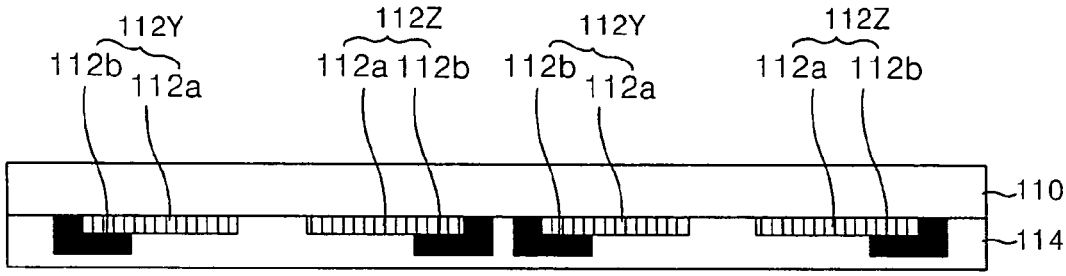
Figure 15:
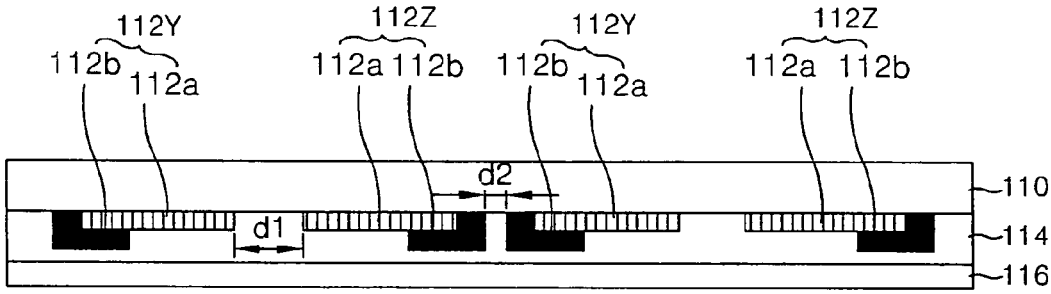

Referring to FIG. 12, a transparent conductive material is deposited on an upper substrate 110 and is then patterned to form transparent electrodes 112*a*. A bus electrode material is formed on the upper substrate 110 having the transparent electrodes 112*a* formed on and is then patterned to form bus electrodes 112*b* that extend over the transparent electrodes 112*a*, as shown in FIG. 13. Referring to FIG. 14, an upper dielectric layer 114 is formed on the upper substrate 110 having the bus electrodes 112*b* formed on by means of a screen printing method, etc. Magnesium oxide being a protection layer material is covered on the upper dielectric layer 114 to form a protection film 116, as shown in FIG. 15.

FIGS. 16 to 20 show a method for manufacturing a lower substrate of the plasma display panel shown in FIG. 10.

Figure 16:
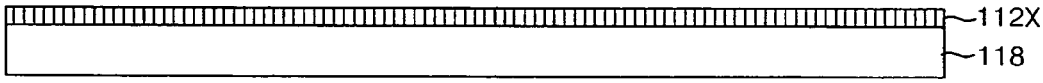
FIGS. 16 to 20 show a method for manufacturing a lower substrate of the plasma display panel shown in FIG. 10.
Figure 17:
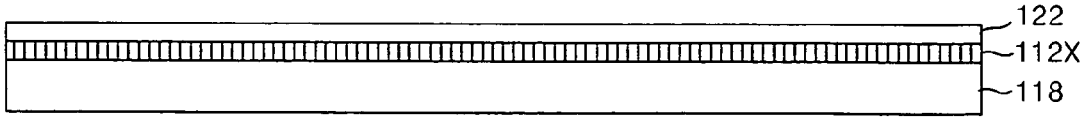

An address electrode 112X is first formed on the lower substrate 118 by means of a photo method, a printing method, etc., as shown in FIG. 16. A paste in which a mixed powder having oxide of a fine powder state mixed with PbO or non-PbO glass fine powder is mixed with an organic solvent based on a composition ratio is covered on the lower substrate 118 having the address electrodes 112X formed on by means of a screen-printing method. Thereafter, the paste covered on the lower substrate 118 is sintered at a given temperature to form a lower dielectric layer 122 on the lower substrate 118 having the address electrode 112X formed on, as shown in FIG. 17.

Figure 18:
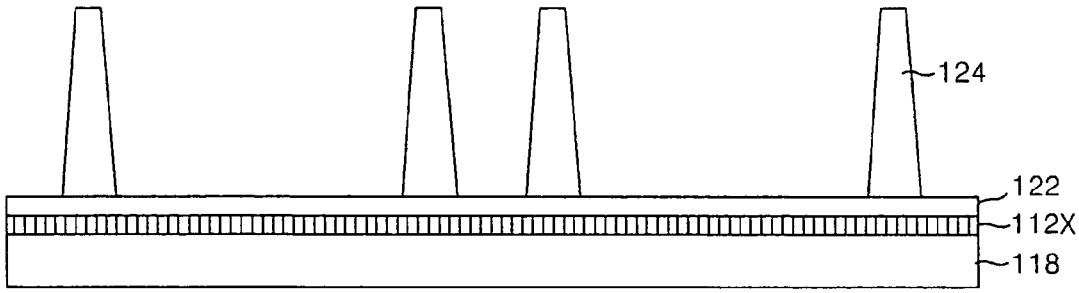

Referring to FIG. 18, barrier ribs 124 having an auxiliary discharge space 115 are formed on the substrate 118 on which the lower dielectric layer 122 is formed by means of a screen printing method, a sand blasting method, a pressing method, etc.

Figure 19:
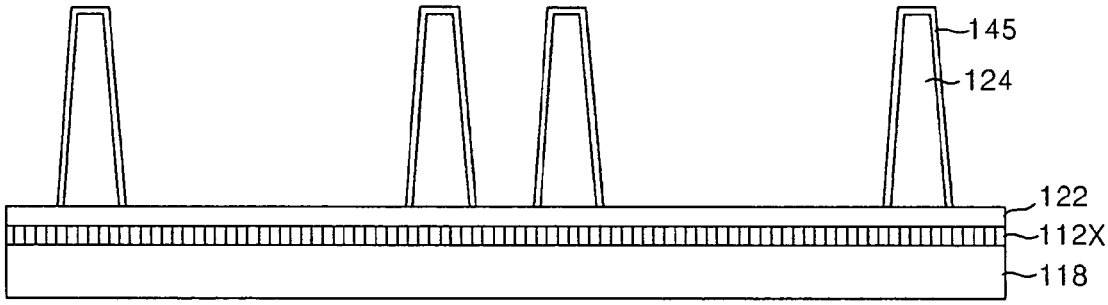

Thereafter, an oxide film 145 including at least one of silicon oxide ($SiO_2$) and magnesium oxide (MgO) is formed on the lattice type barrier rib 124 by means of a screen printing method, etc., as shown in FIG. 19.

Figure 20:
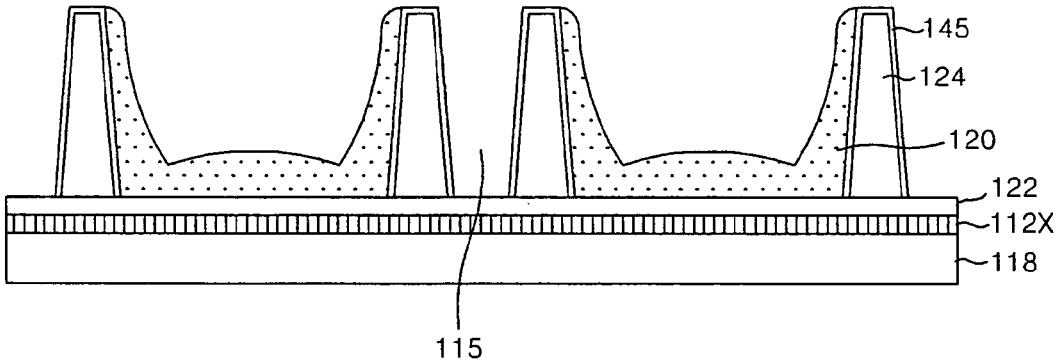

A phosphor layer 120 is formed on the substrate 118 o which the oxide film 145 is formed by means of a screen printing method, etc., as shown in FIG. 20.

The lower substrate of the PDP formed thus is closely adhered to the upper substrate by means of a sealing process (not shown).

According to a PDP and method for manufacturing the same of the present invention as described above, an oxide film of a low dielectric constant is formed on a lattice type barrier rib. The amount of a wall charge formed in barrier ribs is thus minimized. Furthermore, the amount of wall charges formed in electrodes, which is reduced by wall charges formed in the barrier rib, is compensated for by priming particles generated in an auxiliary discharge space. Therefore, since an erroneous discharge of a PDP due to instable address discharge does not occur, the quality of an image of the PDP is improved.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A plasma display panel having a plurality of discharge cells, comprising:

barrier ribs by which a discharge space is defined between an upper substrate and a lower substrate; and an oxide film of a low dielectric constant formed on an entire outer surface of each of the barrier ribs, the low dielectric constant being lower than a dielectric constant of the barrier ribs, and a thickness of the oxide film being less than a thickness of each of the barrier ribs.

2. The plasma display panel as claimed in claim 1, wherein the oxide film comprises at least one of silicon oxide or magnesium oxide.

3. The plasma display panel as claimed in claim 1, further comprising:

a first electrode formed on an underside of the upper substrate; and a second electrode formed on the underside of the upper substrate in such a manner as to extend over the first electrode.

4. The plasma display panel as claimed in claim 3, wherein the barrier ribs comprise:

a first barrier rib arranged in parallel with the first and second electrodes and having an auxiliary discharge space; and a second barrier rib arranged to intersect the first barrier rib.

5. The plasma display panel as claimed in claim 1, wherein the oxide film reduces an amount of wall charges formed on the barrier ribs.

6. The plasma display panel as claimed in claim 1, wherein the entire outer surface of each of the barrier ribs includes sides of each of the barrier ribs.

7. The plasma display panel as claimed in claim 1, wherein one of the barrier ribs extends from a first end near the lower substrate to a second end closer to the upper substrate, the one barrier rib includes two lateral sides each between the first end and the second end, and the entire outer surface of the one barrier rib includes the two lateral sides.

8. A method for manufacturing a plasma display panel, comprising:

forming barrier ribs on a lower substrate so that a discharge space is defined by the barrier ribs between an upper substrate and the lower substrate; and forming an oxide film of a low dielectric constant on an entire outer surface of each of the barrier ribs, the low dielectric constant being lower than a dielectric constant of the barrier ribs, and the oxide film is formed to have a thickness less than a thickness of each of the barrier ribs.

9. The method as claimed in claim 8, wherein the oxide film comprises at least one of silicon oxide or magnesium oxide.

10. The method as claimed in claim 8, further comprising:

forming a first electrode on the upper substrate; and forming a second electrode on the underside of the upper substrate in such a manner as to extend over the first electrode.

11. The method as claimed in claim 10, wherein forming the barrier rib comprises:

forming a first barrier rib arranged in parallel with the first and second electrodes and having an auxiliary discharge space; and forming a second barrier rib that intersects the first barrier rib.

12. The plasma display panel as claimed in claim 8, wherein the oxide film minimizes an amount of wall charges formed on sides of the barrier ribs.

13. The plasma display panel as claimed in claim 8, wherein the entire outer surface of each of the barrier ribs includes sides of each of the barrier ribs.

14. The plasma display panel as claimed in claim 8, wherein one of the barrier ribs extends from a first end near the lower substrate to a second end closer to the upper substrate, the one barrier rib including two lateral sides each between the first end and the second end, and the entire outer surface of the one barrier rib includes the two lateral sides.

15. A plasma display panel having a plurality of discharge cells, comprising:

a plurality of barrier ribs between a first substrate and a second substrate, at least one barrier rib having a first dielectric constant; and a plurality of oxide films each formed on an entire outer surface of a separate one of the barrier ribs, at least one oxide film having a second dielectric constant, the first dielectric constant being greater than the second dielectric constant, and a thickness of the at least one oxide film being less than a thickness of each of the barrier ribs.

16. The plasma display panel as claimed in claim 15, wherein the at least one oxide film includes at least one of silicon oxide or magnesium oxide.

17. The plasma display panel as claimed in claim 15, further comprising:

a first electrode formed on the first substrate; and a second electrode formed on the first substrate and traversing the first electrode.

18. The plasma display panel as claimed in claim 17, wherein the plurality of barrier ribs include:

a first barrier rib arranged substantially in parallel with the first and second electrodes; and a second barrier rib traversing the first barrier rib.

19. The plasma display panel as claimed in claim 15, wherein the oxide film minimizes an amount of wall charges formed on sides of the barrier ribs.

20. The plasma display panel as claimed in claim 15, wherein the entire outer surface of the separate one of the barrier ribs includes sides of the separate one of the barrier ribs.

* * * * *